US006226024B1

(12) United States Patent
Kerr et al.

(10) Patent No.: US 6,226,024 B1
(45) Date of Patent: May 1, 2001

(54) VACUUM IMAGING DRUM WITH VACUUM HOLES FOR MAINTAINING A BOUNDARY IN AN IMAGE PROCESSING APPARATUS

(75) Inventors: Roger S. Kerr, Brockport; Dean L. Smith, Pittsford, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/336,934

(22) Filed: Jun. 21, 1999

(51) Int. Cl.[7] ..... B41J 11/00

(52) U.S. Cl. ..... 347/220; 347/264

(58) Field of Search ..... 347/220, 262; 346/134, 138, 218, 264; 277/275; 271/276, 277; 101/232, 389.1; 400/625

(56) References Cited

U.S. PATENT DOCUMENTS

| | | | |
|---|---|---|---|
| 4,664,345 | 5/1987 | Lurz | 244/209 |
| 5,222,698 | 6/1993 | Nelson et al. | 244/203 |
| 5,268,708 | 12/1993 | Harshbarger et al. | 346/134 |
| 5,428,371 * | 6/1995 | Fox et al. | 347/262 |
| 5,535,967 | 7/1996 | Beauchamp et al. | 244/209 |
| 5,637,942 | 6/1997 | Forni | 340/166 |
| 6,002,419 * | 12/1999 | Kerr et al. | 347/264 |

* cited by examiner

*Primary Examiner*—N. Le
*Assistant Examiner*—K. Feggins
(74) *Attorney, Agent, or Firm*—Nelson Adrian Blish

(57) ABSTRACT

The present invention is for a vacuum imaging drum with vacuum holes for maintaining a boundary layer in an image processing apparatus (10). The image processing apparatus (10) with a vacuum imaging drum (300) for holding thermal print media (32) and donor sheet material (36) in registration on the vacuum imaging drum (300). A printhead (500) moves along a line parallel to the longitudinal axis (X) of the vacuum imaging drum (300) as the vacuum imaging drum (300) rotates. The printhead (500) receives information signals and produces radiation which is directed to the donor sheet material (36) which causes color to transfer from the donor sheet material (36) to the thermal print media (32). The vacuum imaging drum (300) provides vacuum on its surface by means of a first plurality of holes. A second plurality of holes maintains a boundary layer (336) of air along the drum surface.

9 Claims, 6 Drawing Sheets

VACUUM IMAGING DRUM WITH VACUUM HOLES FOR MAINTAINING A BOUNDARY IN AN IMAGE PROCESSING APPARATUS

FIELD OF THE INVENTION

This invention relates to an image processing apparatus of the lathe bed scanning type and more specifically to using vacuum to maintain a boundary layer of air against the surface of an imaging drum revolving at high speed.

BACKGROUND OF THE INVENTION

Pre-press color proofing is a procedure used by the printing industry for creating representative images of printed material without the high cost and time required to actually produce printing plates and set up a high-speed, high-volume, printing press to produce a single example of an intended image. These intended images may require several corrections and may need to be reproduced several times to satisfy customers requirements. By utilizing pre-press color proofing time and money can be saved.

One such commercially available image processing apparatus, disclosed in commonly assigned U.S. Pat. No. 5,268,708, describes image processing apparatus having half-tone color proofing capabilities. This image processing apparatus is arranged to form an intended image on a sheet of thermal print media by transferring dye from a sheet of dye donor material to the thermal print media by applying a sufficient amount of thermal energy to the dye donor material to form an intended image. This image processing apparatus is comprised of a material supply assembly or carousel; lathe bed scanning subsystem, which includes a lathe bed scanning frame, translation drive, translation stage member, printhead, vacuum imaging drum, thermal print media and dye donor material exit transports.

The operation of the image processing apparatus comprises metering a length of the thermal print media, in roll form, from the material assembly or carousel. The thermal print media is cut into sheets, transported to the vacuum imaging drum, registered, wrapped around, and secured onto the vacuum imaging drum. A length of dye donor material, in roll form, is metered out of the material supply assembly or carousel, and cut into sheets. The dye donor material is transported to and wrapped around the vacuum imaging drum, such that it is superposed in the registration with the thermal print media.

After the dye donor material is secured to the periphery of the vacuum imaging drum, the scanning subsystem or write engine writes an image on the thermal print media as the thermal print media and the dye donor material on the spinning vacuum imaging drum is rotated past the printhead. The translation drive traverses the printhead and translation stage member axially along the vacuum imaging drum, in coordinated motion with the rotating vacuum imaging drum to produce the intended image on the thermal print media.

After the intended image has been written on the thermal print media, the dye donor material is removed from the vacuum imaging drum without disturbing the thermal print media that is beneath it. The dye donor material is transported out of the image processing apparatus by the dye donor material exit transport. Additional sheets of dye donor material are sequentially superposed with the thermal print media on the vacuum imaging drum, and imaged onto the thermal print media as described above until the intended image is completed. The completed image on the thermal print media is unloaded from the vacuum imaging drum and transported to an external holding tray on the image processing apparatus by the receiver sheet material exit transport.

The vacuum imaging drum is cylindrical in shape and includes a hollowed-out interior portion. A plurality of holes extending through the drums permit a vacuum to be applied from the interior of the vacuum imaging drum for supporting and maintaining the position of the thermal print media and dye donor material as the vacuum imaging drum rotates.

The outer surface of the vacuum imaging drum has an axially extending flat, which covers approximately eight degrees of the vacuum imaging drum circumference. The purpose of the axially extending flat is to assure that the leading and trailing ends of the dye donor material are partially protected from the effect of the air turbulence during the imaging process, since air turbulence has a tendency to lift the leading or trailing edges of the dye donor material. The vacuum imaging drum axially extending flat also ensures that the leading and trailing ends of the dye donor material are recessed from the vacuum imaging drum periphery. This reduces the chance that the dye donor material will contact other parts of the image apparatus, such as the printhead, which may cause a jam and loss of the intended image or worse, catastrophic damage to the image processing apparatus.

Although the presently known and utilized image processing apparatus is satisfactory, it is not without drawbacks. The donor and receiver media must be held tightly against the surface of the vacuum imaging drum as the drum rotates at high speeds. Near the surface of the rotating drum, a thin boundary layer condition exists in which the laminar flow of air effectively forms a very thin low-pressure region extending around the cylindrical surface of the drum. This boundary layer acts to provide a consistent low-pressure region on the outside of the film media, which is secured to the drum by vacuum. However, any irregularity in the drum surface, such as the axially extending flat, disturbs the laminar flow. This disturbance creates turbulence, in which the boundary layer separates from the drum surface. As a result, a region of high pressure is created, which can effectively slow drum rotation or lift an edge of the dye donor material, causing fly-off of the dye donor material and consequent damage to the image processing apparatus.

As the speed of drum rotation is increased, to increase production speed, this problem is exacerbated. One way to compensate for separation of the boundary layer, is to apply additional vacuum force to hold the leading and trailing edges of the film media against the drum more securely. Increasing the vacuum in the drum, however, requires increased drum thickness, a more heavy duty vacuum pump, and a more powerful drum motor, all of which adds expense.

Boundary layer control is an important consideration in design of aircraft. U.S. Pat. No. 4,664,345 (Lurz) for example, describes control of the boundary layer against an aircraft surface. Here, suction is employed to stabilize the boundary layer and prevent separation from a surface. U.S. Pat. No. 5,222,698 (Nelson et al.) also discloses use of suction to control boundary layer attachment and prevent turbulence. U.S. Pat. No. 5,535,967 (Beauchamp et al.) also describes using suction means to control a boundary layer and maintain laminar flow.

Boundary layer control along surfaces of rotating devices is not well known. U.S. Pat. No. 5,637,942 (Forni) discloses a method for boundary layer control in electric rotors and similar rotating devices. However, the method disclosed is for containing a boundary layer to effect drag reduction and control of axial air-flow for efficient motor operation.

The rotational speed of a vacuum imaging drum is one factor that determines overall throughput of an imaging apparatus. An improvement that allows higher drum speeds would help to increase throughput of the imaging apparatus. It can thus be seen that there is a need for maintaining the boundary layer and minimizing turbulence of surface air for an imaging apparatus that employs a vacuum imaging drum.

SUMMARY OF THE INVENTION

It is the object of the present invention to provide one or more vacuum ports disposed to maintain the boundary layer on a vacuum imaging drum in an imaging apparatus.

According to a feature of the present invention an image processing apparatus comprises a vacuum imaging drum for holding thermal print media and dye donor material, in registration on a surface of the vacuum imaging drum. A printhead prints information to the thermal print media as the printhead is moved parallel to a surface of the vacuum imaging drum. The vacuum imaging drum has at least one boundary layer vacuum port located between a leading edge and a trailing edge of the dye donor material to maintain a boundary layer around the vacuum imaging drum as the vacuum imaging drum rotates.

An advantage of the present invention is that it adds no components to an existing drum design. A further advantage is that changes to the weight distribution of the drum are negligible. The invention and its objects and advantages will become more apparent in the detailed description of the preferred embodiment presented below.

DETAILED DESCRIPTION OF THE INVENTION

Figure 1:
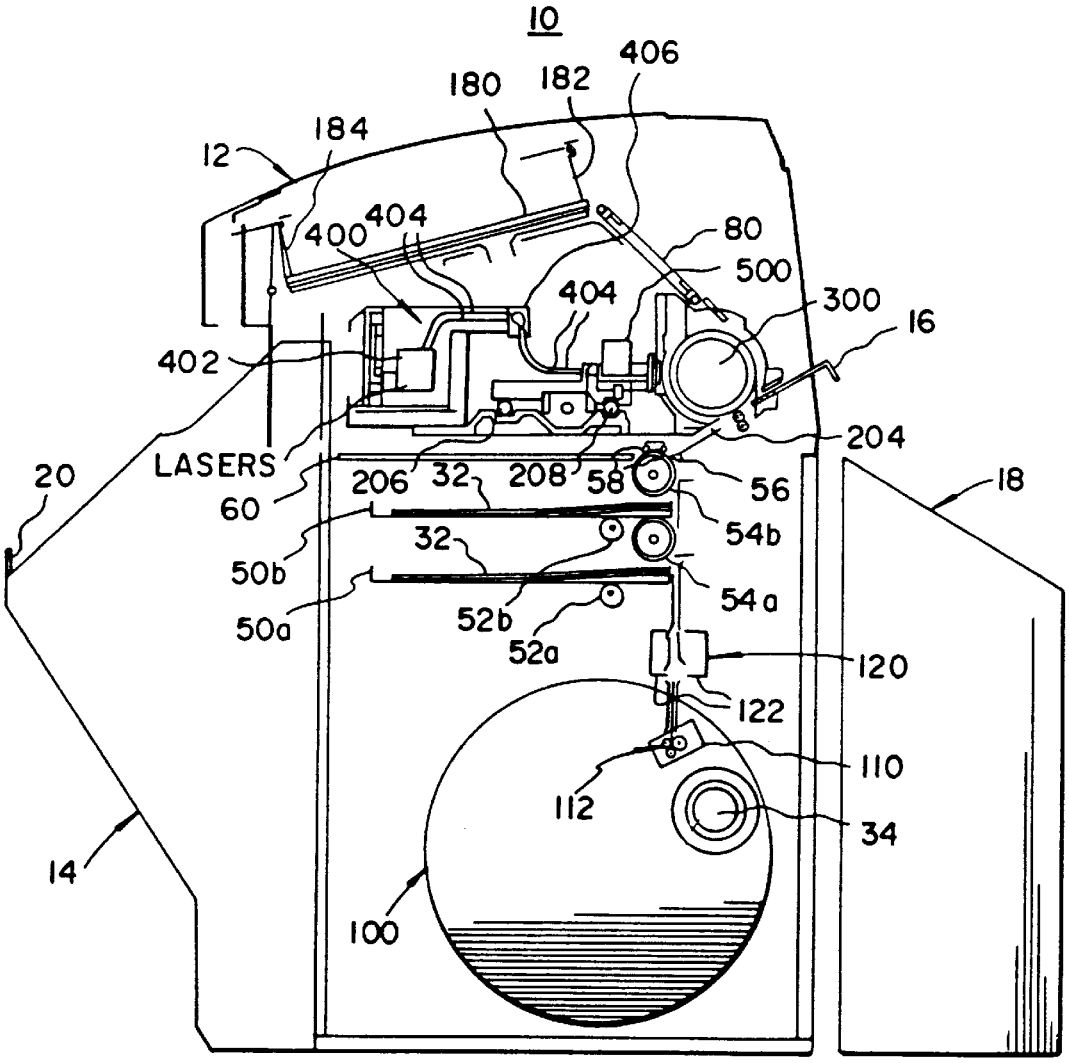
FIG. 1 is a side view in vertical cross section of an image processing apparatus of the present invention.

Referring to FIG. 1, there is illustrated an image processing apparatus 10 according to the present invention having an image processor housing 12 which provides a protective cover. A movable, hinged image processor door 14 is attached to the front portion of image processor housing 12 permitting access to two sheet material trays, a lower sheet material tray 50*a* and an upper sheet material tray 50*b*, that are positioned in the interior portion of image processor housing 12 for supporting thermal print media 32, thereon. Only one of sheet material trays will dispense thermal print media 32 to create an intended image thereon; the alternate sheet material tray either holds an alternative type of thermal print media 32 or functions as a back up sheet material tray. In this regard, lower sheet material tray 50*a* includes a lower media lift cam 52*a* for lifting lower sheet material tray 50*a* and ultimately thermal print media 32, upwardly toward a rotatable, lower media roller 54*a* and towards a second rotatable, upper media roller 54*b* which, when both are rotated, permits thermal print media 32 to be pulled upwardly towards a media guide 56. Upper sheet material tray 50*b* includes an upper media lift cam 52*b* for lifting upper sheet material tray 50*b* and ultimately thermal print media 32 towards upper media roller 54*b* which directs it towards media guide 56.

Movable media guide 56 directs the thermal print media 32 under a pair of media guide rollers 58 which engages the thermal print media 32 for assisting upper media roller 54*b* in directing it onto a media staging tray 60. Media guide 56 is attached and hinged to a lathe bed scanning frame 202 (shown in FIG. 2) at one end, and is uninhibited at its other end for permitting multiple positioning media guide 56. Media guide 56 then rotates its uninhibited end downwardly, as illustrated in the position shown, and the direction of rotation of upper media roller 54*b* is reversed for moving thermal print media 32 resting on media staging tray 60 under a pair of media guide rollers 58, upwardly through an entrance passageway 204 and around a rotatable vacuum imaging drum 300.

A roll of donor roll material 34 is connected to a media carousel 100 in a lower portion of image processor housing 12. Four rolls of media are used, but only one is shown for clarity. Each roll media includes a donor roll material 34 of a different color, typically black, yellow, magenta and cyan. These donor roll materials 34 are ultimately cut into donor sheet materials 36 (not shown) and passed to a vacuum imaging drum 300 for forming the medium from which is imbedded therein are passed to the thermal print media 32 resting thereon, which process is described in detail herein below. In this regard, a media drive mechanism 110 is attached to each roll of donor roll material 34, and includes three media drive rollers 112 through which the donor roll material 34 of interest is metered upwardly into a media knife assembly 120. After the donor roll material 34 reaches a predetermined position, media drive rollers 112 cease driving donor roll material 34 and two media knife blades 122 positioned at the bottom portion of the media knife assembly 120 cut the donor roll material 34 into donor sheet materials 36. Lower media roller 54*a* and upper media roller 54*b* along with media guide 56 then pass donor sheet material 36 onto media staging tray 60 and ultimately to vacuum imaging drum 300 and in registration with the thermal print media 32 using the same process as described above for passing thermal print media 32 onto vacuum imaging drum 300. Donor sheet material 36 now rests atop thermal print media 32 with a narrow space between the two created by microbeads imbedded in the surface of thermal print media 32.

A laser assembly 400 includes a quantity of laser diodes 402 in its interior, laser diode 402 are connected via fiber optic cables 404 to a distribution block 406 and ultimately to a printhead 500. Printhead 500 directs thermal energy received from laser diodes 402 causing donor sheet material 36 to pass the desired color across the gap to thermal print media 32. Printhead 500 is attached to a lead screw 250, shown in FIG. 2, via a lead screw drive nut 254 and a drive coupling (not shown) for permitting movement axially along the longitudinal axis of vacuum imaging drum 300 for transferring the data to create the intended image onto thermal print media 32.

Figure 5A:
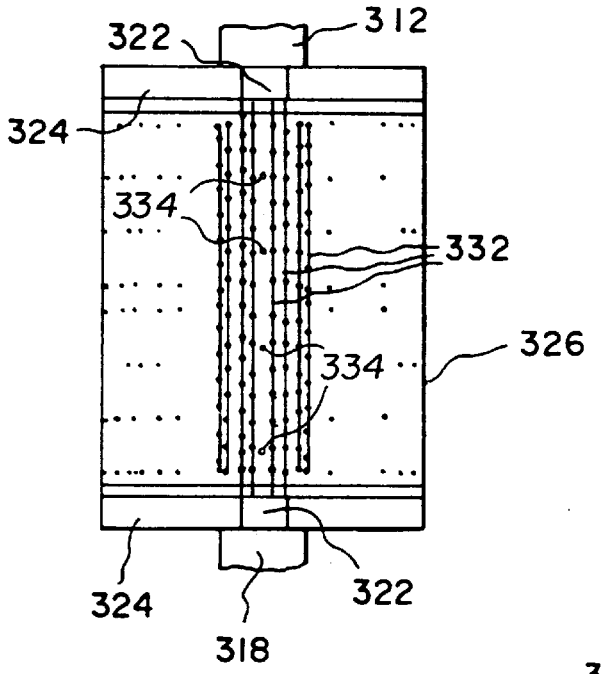
FIGS. 5A–5C are plane views of the vacuum imaging drum showing the sequence of placement for the thermal print media and dye donor material.
Figure 5B:
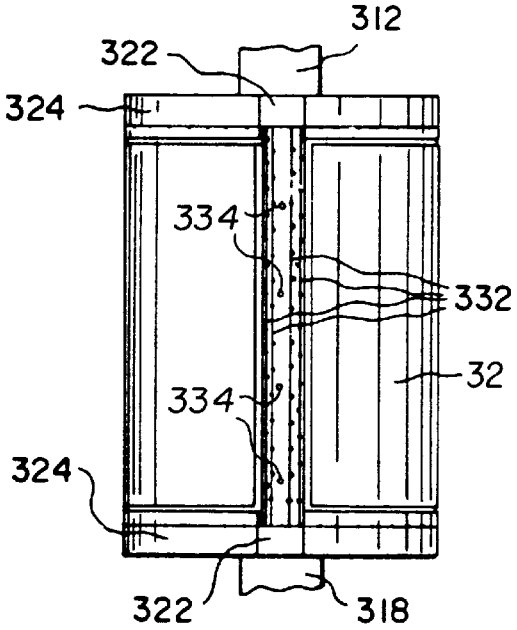
Figure 5C:
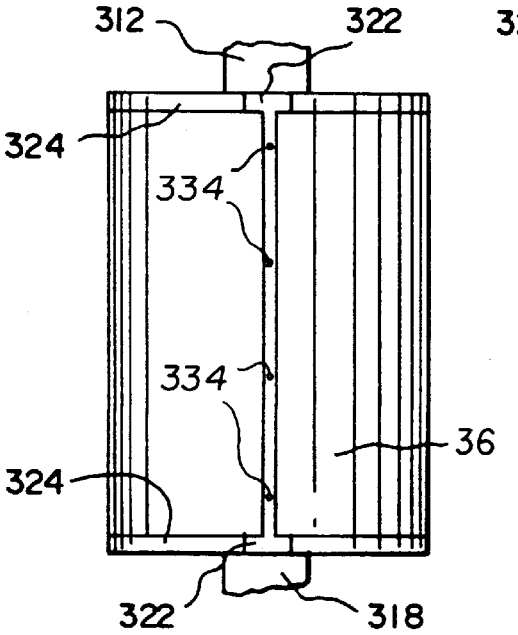

For writing, vacuum imaging drum 300 rotates at a constant velocity, and printhead 500 begins at one end of thermal print media 32 and traverse the entire length of thermal print media 32 for completing the transfer process for the particular donor sheet material 36 (shown in FIG. 5C)

resting on thermal print media 32. After printhead 500 has completed the transfer process, for the particular donor sheet material 36 resting on thermal print media 32 donor sheet material 36 is then removed from vacuum imaging drum 300 and transferred out image processor housing 12 via a skive or donor ejection chute 16. The donor sheet material 36 eventually comes to rest in a waste bin 18 for removal by the user. The above described process is then repeated for the other three rolls of donor roll materials.

After the colors from all four sheets of donor sheet materials 36 have been transferred and donor sheet materials 36 have been removed from vacuum imaging drum 300, thermal print media 32 is removed from vacuum imaging drum 300 and transported via a transport mechanism 80 to a color binding assembly 180. A media entrance door 182 of color binding assembly 180 is opened for permitting thermal print media 32 to enter color binding assembly 180, and shuts once thermal print media 32 comes to rest in color binding assembly 180. Color binding assembly 180 processes thermal print media 32 for further binding the transferred colors on thermal print media 32 and for sealing the microbeads thereon. After the color binding process has been completed, media exit door 184 is opened and thermal print media 32 with the intended image thereon passes out of color binding assembly 180 and image processor housing 12 and comes to rest against media stop 20.

Figure 2:
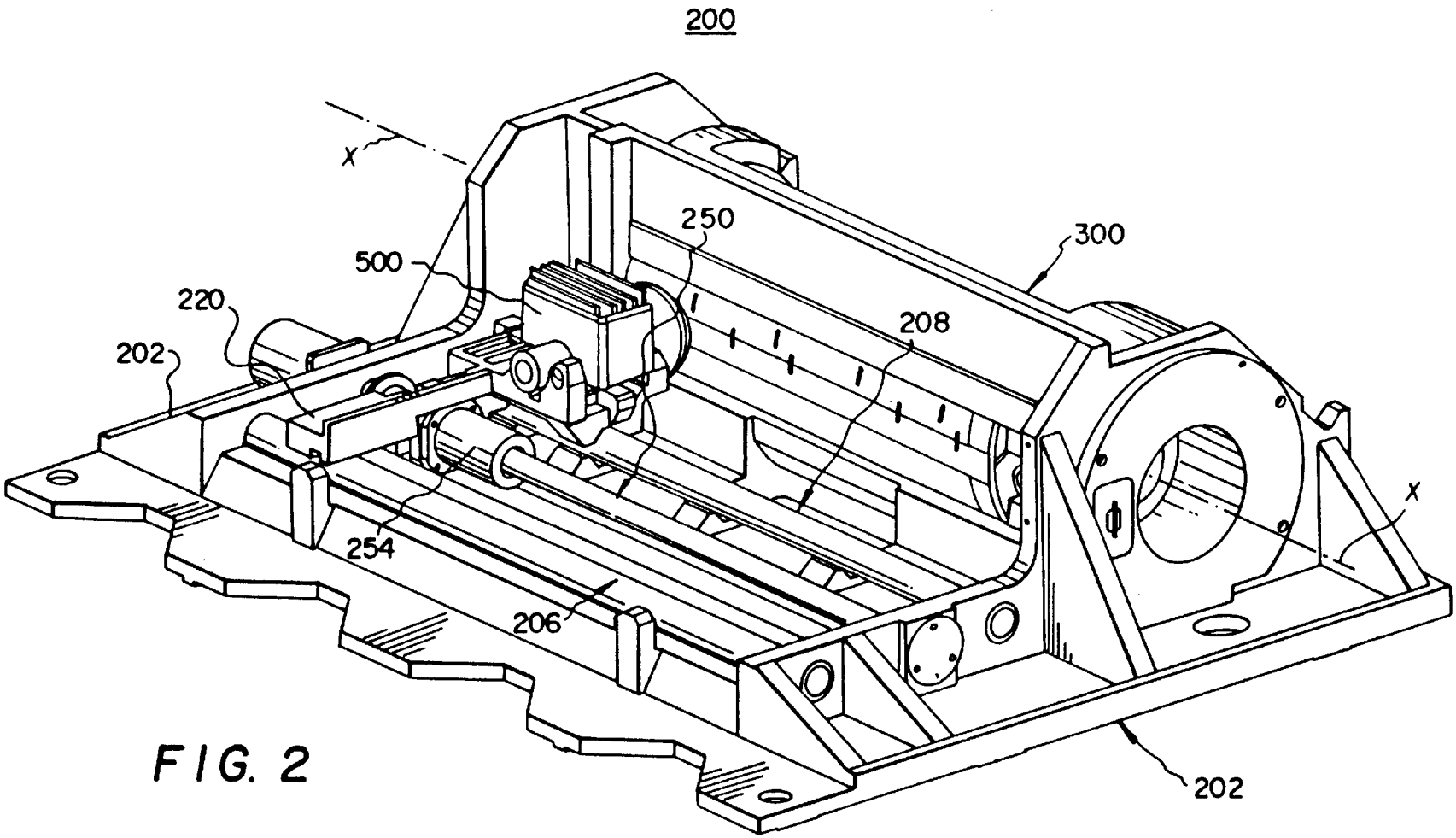
FIG. 2 is a perspective view of the lathe bed scanning subsystem of the present invention.

Referring to FIG. 2, there is illustrated a perspective view of the lathe bed scanning subsystem 200 of image processing apparatus 10, including vacuum imaging drum 300, printhead 500 and lead screw 250 assembled in lathe bed scanning frame 202. Vacuum imaging drum 300 is mounted for rotation about an axis X in lathe bed scanning frame 202. Printhead 500 is movable with respect to vacuum imaging drum 300, and is arranged to direct a beam of light to donor sheet material 36 (shown in FIG. 5C). The beam of light from printhead 500 for each laser diode 402 (not shown in FIG. 2) is modulated individually by modulated electronic signals from image processing apparatus 10, which are representative of the shape and color of the original image, so that the color on donor sheet material 36 is heated to cause volatilization only in those areas in which its presence is required on thermal print media 32 to reconstruct the shape and color of the original image.

Printhead 500 is mounted on a movable translation stage member 220 which, in turn, is supported for low friction slidable movement on translation bearing rods 206 and 208. Translation bearing rods 206 and 208 are sufficiently rigid so as not to sag or distort as is possible between their mounting points and are arranged as parallel as possible with the axis X of the vacuum imaging drum 300 with the axis of the printhead 500 perpendicular to axis X of the vacuum imaging drum 300. A front translation bearing rod 208 locates a translation stage member 220 in the vertical and the horizontal directions with respect to axis X of vacuum imaging drum 300. A rear translation bearing rod 206 locates translation stage member 220 only with respect to rotation of translation stage member 220 about front translation bearing rod 208 so that there is no over-constraint condition of translation stage member 220 which might cause it to bind, chatter, or otherwise impart undesirable vibration or jitters to printhead 500 during the generation of an intended image.

Printhead 500 travels in a path along vacuum imaging drum 300, while being moved at a speed synchronous with vacuum imaging drum 300 rotation and proportional to the width of a writing swath 450 (not shown). The pattern that printhead 500 transfers to the thermal print media 32 along vacuum imaging drum 300, is a helix.

Figure 3:
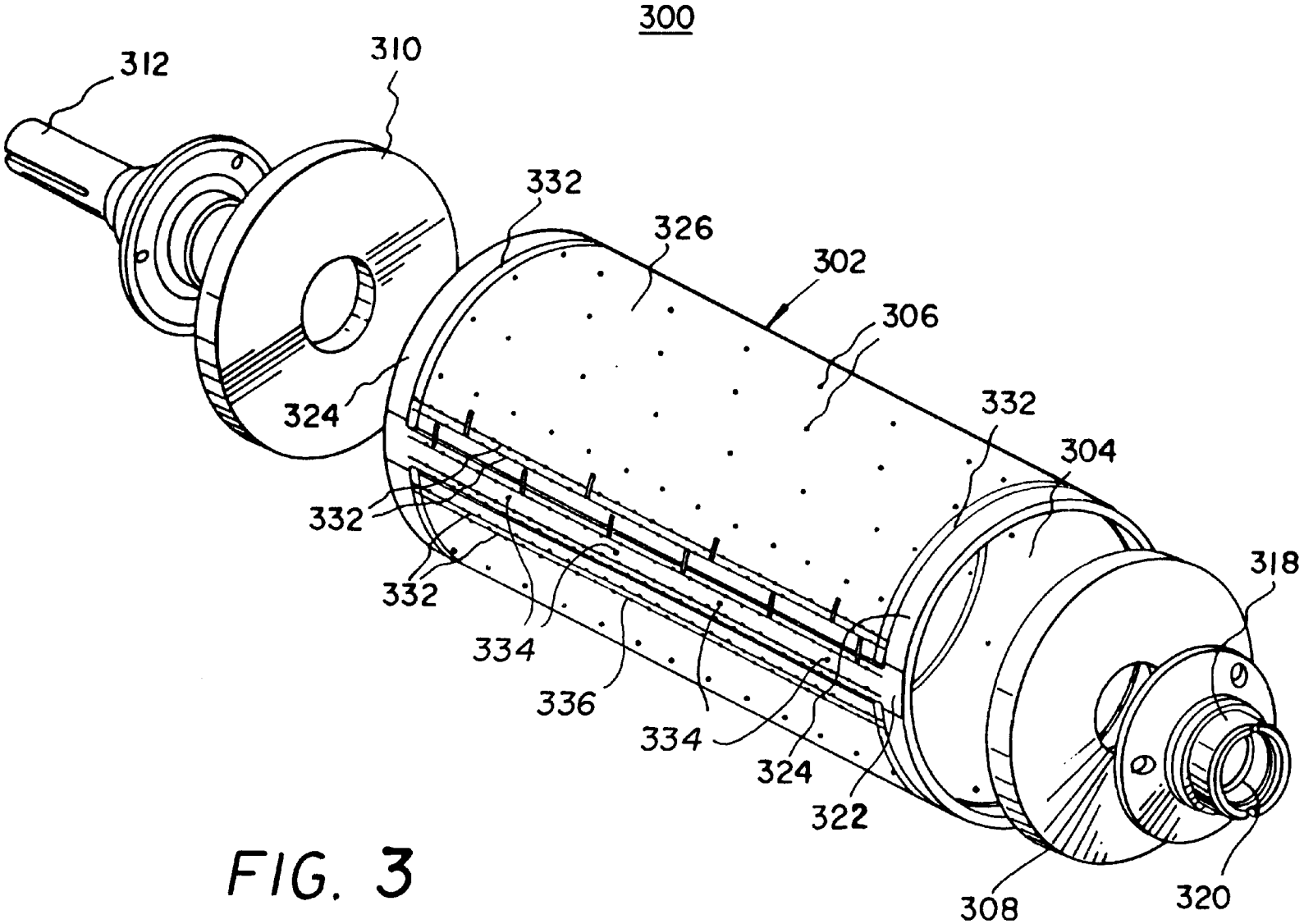
FIG. 3 is an exploded, perspective view of the vacuum imaging drum of the present invention, showing the placement of additional vacuum ports for boundary layer control.
Figure 4:
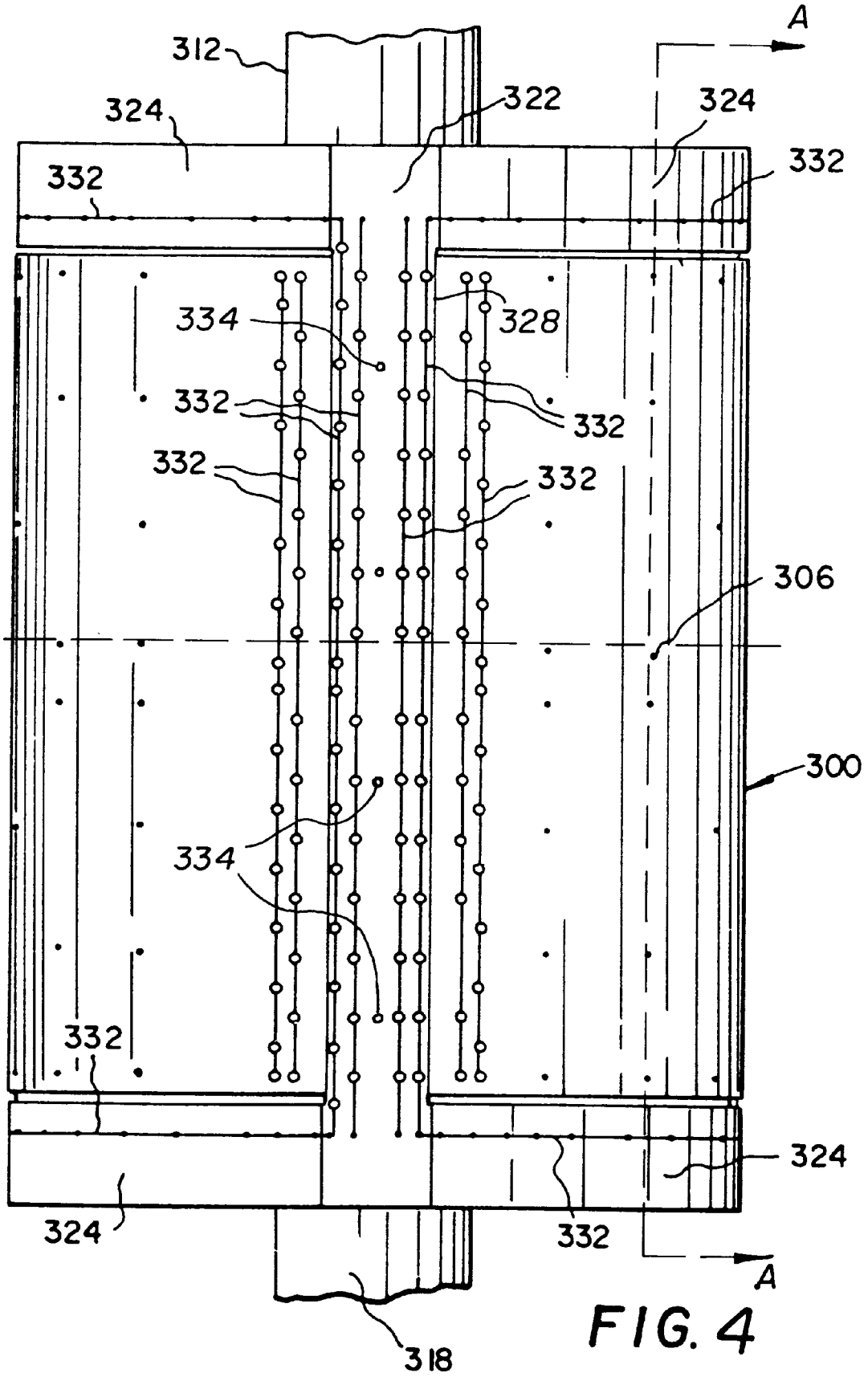
FIG. 4 is a plane view of the vacuum imaging drum surface of the present invention, showing the placement of additional vacuum ports for boundary layer control.

Referring to FIG. 3, there is illustrated an exploded view of vacuum imaging drum 300. Vacuum imaging drum 300 has a cylindrical shaped vacuum drum housing 302 that has a hollowed-out interior portion 304, and further includes a plurality of vacuum grooves 332 and vacuum holes 306 which extend through vacuum drum housing 302 for permitting a vacuum to be applied from hollowed-out interior portion 304 of vacuum imaging drum 300 for supporting and maintaining position of thermal print media 32, and donor sheet material 36, as vacuum imaging drum 300 rotates.

The ends of vacuum imaging drum 300 are closed by a vacuum end plate 308, and a drive end plate 310. Drive end plate 310, is provided with a centrally disposed drive spindle 312 which extends outwardly therefrom. Drive spindle 312 is stepped down to receive a DC drive motor armature 316 (not shown) and mount a drum encoder 344 (also not shown).

Vacuum spindle 318 is provided with a central vacuum opening 320 that aligns with and accepts a vacuum fitting 222 (not shown). Vacuum fitting 222 is connected to a high-volume vacuum blower 224 (not shown) which is capable of producing 50–60 inches of water (93.5–112.2 mm of mercury) at an air flow volume of 60–70 cfm (28.368–33.096 liters per second). This provides the vacuum imaging drum 300 for supporting the various internal vacuum levels of vacuum imaging drum 300 required during the loading, scanning and unloading of thermal print media 32 and donor sheet materials 36 (shown in FIG. 5C) to create the intended image. With no media loaded on vacuum imaging drum 300, the internal vacuum level of vacuum imaging drum 300 is approximately 10–15 inches of water (18.7–28.05 mm mercury). With just thermal print media 32 loaded on vacuum imaging drum 300 the internal vacuum level of vacuum imaging drum 300 is approximately 20–25 inches of water (37.4–46.75 mm of mercury). This level is required such that when a donor sheet material 36 is removed, thermal print media 32 does not move. Otherwise, color to color registration would be adversely affected. With both thermal print media 32 and donor sheet material 36 completely loaded on vacuum imaging drum 300 the internal vacuum level of vacuum imaging drum 300 is approximately 50–60 inches of water (93.5–112.2 mm of mercury) in this configuration.

The outer surface of vacuum imaging drum 300 is provided with an axially extending flat 322 shown in FIGS. 4 and 5A–C, which extends approximately 8 degrees of the vacuum imaging drum 300 circumference. Vacuum imaging drum 300 is also provided with donor support rings 324 which form a circumferential recess 326 which extends from one side of axially extending flat 322 circumferentially around vacuum imaging drum 300 to the other side of axially extending flat 322, and from approximately one inch (24.4 mm) from one end of vacuum imaging drum 300 to approximately one inch (25.4 mm) from the other end of vacuum imaging drum 300.

Thermal print media 32, when mounted on the vacuum imaging drum, is seated within circumferential recess 326. To accommodate media sheet sizes, donor support rings 324 have a thickness substantially equal to thermal print media 32 thickness seated therebetween, which is approximately 0.004 inches (0.102 mm) in thickness. The purpose of circumferential recess 326 on vacuum imaging drum 300 surface is to eliminate any creases in donor sheet material 36, as the sheet is drawn down over thermal print media 32 during the loading of donor sheet material 36. This ensures that no folds or creases will be generated in donor sheet material 36 which could extend into the image area and adversely affect the intended image. Circumferential recess 326 also substantially eliminates the entrapment of air along the edge of thermal print media 32, where it is difficult for vacuum holes 306 in vacuum imaging drum 300 to assure the removal of the entrapped air. Any residual air between thermal print media 32 and donor sheet material 36, can also adversely affect the intended image.

Formed in the donor support rings 324 along the edges of axially extending flat 322 are media contours 328. Axially extending flat 322 and media contours 328 are somewhat the same, they assure that the leading and trailing ends of donor sheet material 36 are somewhat protected from the effect of increased air turbulence during the relatively high speed rotation that vacuum imaging drum 300 undergoes during the image scanning process. Thus increased air turbulence will have less tendency to lift or separate the leading or trailing edges of donor sheet material 36 from vacuum imaging drum 300. In addition, axially extending flat 322 and media contours 328 ensure that the leading and trailing ends of donor sheet material 36 are recessed from the periphery of vacuum imaging drum 300. This reduces the chance that donor sheet material 36 can come in contact with other parts of image processing apparatus 10, such as printhead 500. Inadvertent contact could cause a media jam within the image processing apparatus, resulting in the possible loss of the intended image or, at worst, catastrophic damage to image processing apparatus 10 possibly damaging printhead 500.

Media contours 328 support the corners of donor sheet material 36 preventing flutes or air under the corners of donor sheet material 36. This helps to allow full contact with the surface of vacuum imaging drum 300 and minimize the tendency of the media to lift or separate from vacuum imaging drum 300 when rotating at high speeds.

FIG. 5A illustrates a plane view of the surface of vacuum imaging drum 300, prior to loading a sheet of media. FIG. 5B shows vacuum imaging drum 300 after loading a single sheet of thermal media 32. FIG. 5C shows vacuum imaging drum 300 after loading a sheet of donor sheet material 36 on top of the sheet of thermal media 32.

Figure 6A:
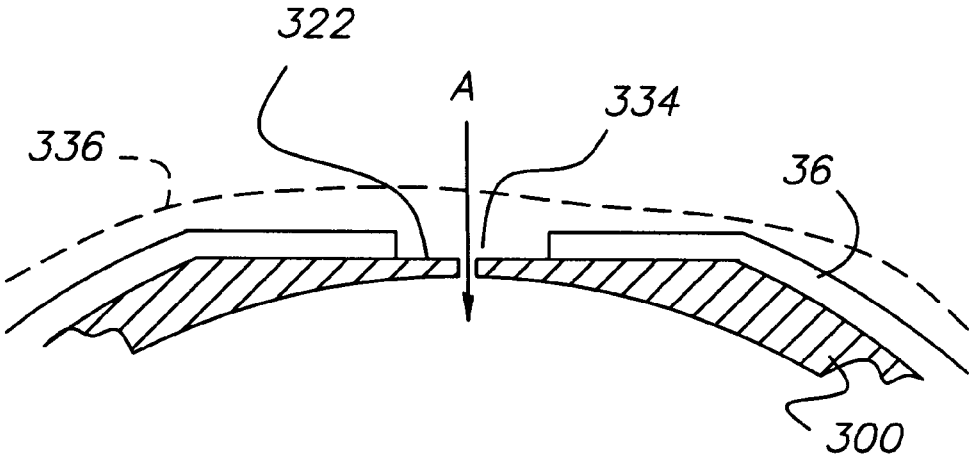
FIGS. 6A and 6B are sectional views along line 6—6 of FIG. 5C contrasting boundary layer response with and without the vacuum ports used in the present invention.
Figure 6B:
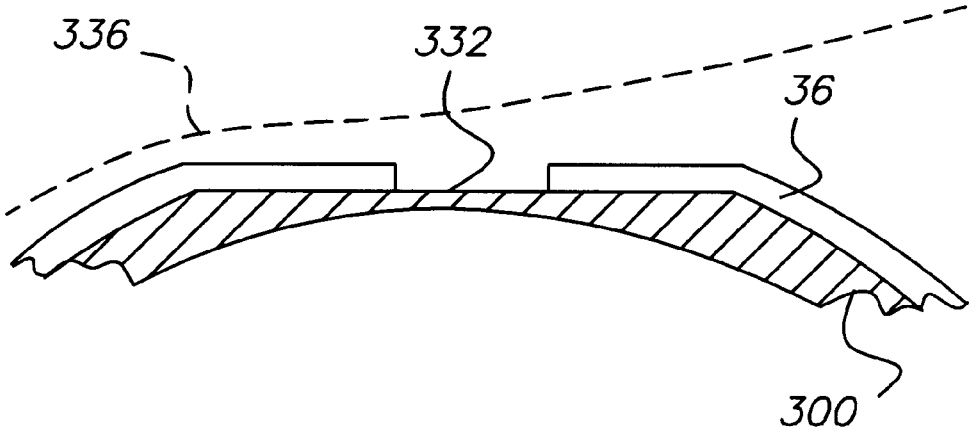

Boundary layer vacuum ports 334, shown in FIGS. 3, 4, and 5A–C, are centered within the width of axially extending flat 322. As FIG. 5C shows, boundary layer vacuum ports 334 are not covered by thermal media 32 or donor sheet material 36. This arrangement allows boundary layer vacuum ports 334 to provide suction (indicated by arrow A in FIG. 6A) that thins a boundary layer 336 of air (indicated with a dashed line) along the surface of vacuum imaging drum 300. FIG. 6B shows detachment of boundary layer 336 which occur over axially extending flat 322 at high rotational speeds if boundary layer vacuum ports 334 are not provided.

The size and number of boundary layer vacuum ports 334 are determined to suit the specific application. In the preferred embodiment, four boundary layer vacuum ports 334 are provided, each having a radius of 0.34 mm. No vacuum force in addition to that described above is provided. Even one boundary layer vacuum port, however, would decrease separation of the boundary layer if more than one boundary layer vacuum port is used in the preferred embodiment the vacuum layer boundary ports are at equally spaced intervals. For example, if two boundary layer vacuum ports are used, the distance between each end of the axially extending flat and the boundary port and the distance between boundary layer vacuum ports are equal. The use of boundary layer vacuum ports as described in the present invention allows for faster rotation of the vacuum imaging drum, which results in faster processing of intended images. This allows for more efficient utilization of equipment and quicker response time to customers needs. An additional benefit of the present invention is that there is a decreased possibility of the dye donor material lifting off the vacuum imaging drum and causing damage to the printhead and other components.

The invention has been described with reference to the preferred embodiment thereof. However, it will be appreciated and understood that variations and modifications can be effected within the scope of the invention as described herein above and as defined in the appended claims by a person of ordinary skill in the art without departing from the scope of the invention. For example, the specific arrangement or number of boundary layer vacuum ports 334 in the drum surface may be different from that represented in FIGS. 3, 4, and 5A–C. This invention could also be employed with a vacuum imaging drum that does not use an axially extending flat, but has some other surface obtrusion that could cause boundary layer separation. In addition, precise placement, number, and sizing of boundary layer vacuum ports 334 depend on the size of the surface irregularity and rotational speed of the drum. Although not described in detail it would be obvious to one skilled in the art that this invention could be used in other applications, including single sheet vacuum imaging drums, and other apparatus where it is desirable to hold a sheet of media on a rotating vacuum imaging drum.

PARTS LIST

10. Image processing apparatus
12. Image processor housing
14. Image processor door
16. Donor ejection chute
18. Waste bin
20. Media stop
32. Thermal print media
34. Donor roll material
36. Donor sheet material
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
180. Color binding assembly
182. Media entrance door
184. Media exit door
200. Lathe bed scanning subsystem
202. Lathe bed scanning frame
204. Entrance passageway
206. Rear translation bearing rod
208. Front translation bearing rod
220. Translation stage member
222. Vacuum fitting
224. Vacuum blower

250. Lead screw
254. Lead screw drive nut
300. Vacuum imaging drum
301. Axis of rotation
302. Vacuum drum housing
304. Hollowed out interior portion
306. Vacuum hole
308. Vacuum end plate
310. Drive end plate
312. Drive spindle
314. Support bearing
316. DC drive motor armature
318. Vacuum spindle
320. Central vacuum opening
322. Axially extending flat
324. Donor support ring
326. Circumferential recess
328. Media contours
332. Vacuum grooves
334. Boundary layer vacuum port
336. Boundary layer
344. Drum encoder
400. Laser assembly
402. Lasers diode
404. Fiber optic cables
406. Distribution block
450. Writing swath
452. Pixel to pixel distance
500. Printhead

What is claimed is:

1. An image processing apparatus comprising:

a vacuum imaging drum having vacuum holes in a surface of said vacuum imaging drum for holding thermal print media and dye donor material, in registration with said thermal print media, on said surface of said vacuum imaging drum;

a printhead for printing information to said thermal print media as said printhead is moved parallel to said surface of said vacuum imaging drum by a translation stage member; and wherein said vacuum imaging drum has at least one boundary layer vacuum port located between a leading edge and a trailing edge of said dye donor material to maintain a boundary layer around said vacuum imaging drum as said vacuum imaging drum rotates.

2. An image processing apparatus as in claim 1, wherein said boundary layer vacuum port is located on an axially extending flat on said surface of said vacuum imaging drum.

3. An image processing apparatus as in claim 1, wherein a second boundary layer vacuum port is located on an axially extending flat on said surface of said vacuum imaging drum and wherein said second boundary layer vacuum port and said at least one boundary layer vacuum port are at regularly spaced intervals.

4. In an image processing apparatus comprising:

a vacuum imaging drum, which holds media on a surface of said vacuum imaging drum by means of a vacuum;

a printhead which writes data to said media; and wherein boundary layer vacuum ports are located on said surface of said vacuum imaging drum between a leading edge and a trailing edge of said media so that said boundary layer vacuum ports diminish boundary layer separation between said leading edge and said trailing edge.

5. An image processing apparatus as in claim 4, wherein said boundary layer vacuum ports are located on an axial extending flat on said surface of said vacuum imaging drum.

6. A vacuum imaging drum for securing a sheet of media on a surface of said vacuum imaging drum, comprising:

vacuum holes disposed on said surface of said vacuum imaging drum for securely gripping said sheet of media wrapped on said surface of said vacuum imaging drum; and boundary layer vacuum ports located between a leading edge and a trailing edge of said sheet of media wherein said boundary layer vacuum ports maintain attachment of a boundary layer of air during rotation of said vacuum imaging drum.

7. A vacuum imaging drum as in claim 6, wherein said boundary layer vacuum ports are located on an axial extending flat on said surface of said vacuum imaging drum.

8. A method for holding a sheet of media on a rotating vacuum imaging drum comprising the steps of:

drawing a vacuum in a hollow interior portion of said vacuum imaging drum;

creating a vacuum on a surface of said vacuum imaging drum by means of vacuum holes extending between a surface of said vacuum imaging drum and said hollow interior;

mounting said sheet of media on said surface of said vacuum imaging drum, said sheet of media being held on said surface by said vacuum holes; and wherein at least two boundary layer vacuum ports are located between a leading edge and a trailing edge of said sheet of media and maintain a boundary layer above said media as said vacuum imaging drum rotates.

9. A method as in claim 8, wherein said boundary layer vacuum ports are located on an axially extending flat on said surface of said vacuum imaging drum.

* * * * *